US007217852B1

(12) United States Patent
DeHaan et al.

(10) Patent No.: US 7,217,852 B1
(45) Date of Patent: May 15, 2007

(54) PROCESS FOR PRODUCING MIDDLE DISTILLATES AND MIDDLE DISTILLATES PRODUCED BY THAT PROCESS

(75) Inventors: Robert DeHaan, Sasolburg (ZA); Luis Pablo Dancuart, Sasolburg (ZA); Mark Jan Prins, Sasolburg (ZA); Ewald Watermeyer DeWet, Vanderbijlpark (ZA)

(73) Assignee: Sasol Technology (PTY) Ltd., Johannesburg (ZA)

( * ) Notice: Subject to any disclaimer, the term of this patent is extended or adjusted under 35 U.S.C. 154(b) by 0 days.

(21) Appl. No.: 09/787,668

(22) PCT Filed: Sep. 17, 1999

(86) PCT No.: PCT/ZA99/00096

§ 371 (c)(1),
(2), (4) Date: Jun. 8, 2001

(87) PCT Pub. No.: WO00/20535

PCT Pub. Date: Apr. 13, 2000

(30) Foreign Application Priority Data

Oct. 5, 1998 (ZA) ..... 98/9038

(51) Int. Cl.
*C07C 5/13* (2006.01)
*C10G 7/00* (2006.01)
*C10G 1/00* (2006.01)

(52) U.S. Cl. ..... 585/734; 585/737; 208/18; 44/300; 44/451

(58) Field of Classification Search ..... 44/300, 44/451; 585/734, 737; 208/18
See application file for complete search history.

(56) References Cited

U.S. PATENT DOCUMENTS 5,378,348 A 1/1995 Davis et al.

FOREIGN PATENT DOCUMENTS

WO WO97/14769 4/1997
WO WO98/34998 8/1998

*Primary Examiner*—Tam M. Nguyen
(74) *Attorney, Agent, or Firm*—Merchant & Gould P.C.

(57) ABSTRACT

This invention relates to middle distillates having good cold flow properties, such as the Cold Filter Plugging Point (CFPP) measured in accordance with the IP method (309), and a high Cetane number, as well as to a process for production of such distillates. More particularly, this invention relates to middle distillates produced from a mainly paraffinic synthetic crude which is produced by the reaction of CO and $H_2$, typically by the Fischer-Tropsch (FT) process. The middle distillates of the invention are predominantly isoparaffinic, the isoparaffins being methyl, ethyl and/or propyl branched. The invention also provides a diesel fuel composition including the middle distillates in accordance with the invention. A process for preparing the middle distillates is also included in the invention.

17 Claims, 4 Drawing Sheets

PROCESS FOR PRODUCING MIDDLE DISTILLATES AND MIDDLE DISTILLATES PRODUCED BY THAT PROCESS

FIELD OF THE INVENTION

This invention relates to middle distillates having good cold flow properties, such as the Cold Filter Plugging Point (CFPP) measured in accordance with the IP method 309, and a high Cetane number, as well as to a process for production of such distillates. More particularly, this invention relates to middle distillates produced from a mainly paraffinic synthetic crude which is produced by the reaction of CO and $H_2$, typically by the Fischer-Tropsch (FT) process.

BACKGROUND TO THE INVENTION

Waxy products of a FT hydrocarbon synthesis process, particularly the products of a cobalt and/or iron based catalytic process, contain a high proportion of normal paraffins. Primary FT products provide notoriously poor cold flow properties, making such products difficult to use where cold flow properties are vital, e.g. diesel fuels, lube oil bases and jet fuel. It is known in the art that cold flow properties of a middle distillate, such as jet fuel, can be improved by increasing the branching of the paraffins of distillates within the proper boiling range, as well as by hydrocracking and hydroisomerising heavier components. Hydrocracking, however, produces smaller amounts of gases and light products, which reduce the yield of valuable distillates. There remains an incentive for a process to maximize middle distillates obtained from FT waxes having good cold flow properties and a high Cetane number.

The middle distillate fuel described in this invention is produced from a highly paraffinic synthetic crude (syncrude) obtained from synthesis gas (syngas) through a reaction like the FT reaction. The FT primary products cover a broad range of hydrocarbons from methane to species with molecular masses above 1400; including mainly paraffinic hydrocarbons and much smaller quantities of other species such as olefins, and oxygenates.

The prior art teaches in U.S. Pat. No. 5,378,348 that by hydrotreating and isomerizing the products from a Fisher-Tropsch reactor one can obtain a jet fuel with freezing point of −34° C. or lower due to the isoparaffinic nature of this fuel. This increased product branching relative to the waxy paraffin feed corresponds with a Cetane rating (combustion) value less than that for normal (linear) paraffins, depicting that an increase in branching reduces the Cetane value of paraffinic hydrocarbon fuels.

Further, WO 97/14769 discloses diesel fuels having excellent lubricity, oxidative stability and high cetane number produced from the non-shifting Fischer-Tropsch processes and having >95 wt % paraffins with an iso to normal ratio of from 0.3 to 3.0. No mention is made regarding the effect of branching on the cold flow properties or the cetane number.

Still further, WO 98/34998 discloses a process for producing additve compositions, especially via a Fischer-Tropsch reaction, useful for improving the cetane number or lubricity of a middle distillate diesel fuel. The additive is prepared by fractionating the products of a Fischer-Tropsch reaction into a low boiling 371 deg C. fraction and a high boiling fraction, and hydroisomerising the high boiling fraction into a low boiling fraction and blending the low boiling fraction and the hydroisomerised high boiling fraction to produce the additive having >90 wt % $C_{16}$ to $C_{20}$ paraffins of which >50 wt % are isoparaffins. This disclosure does not disclose that a diesel fuel having good cold flow properties and high cetane number can be produced, only an additive, also the disclosure requires hydroisomerisation of a high boiling fraction which leads to a loss of material from the diesel boiling range into lighter material and to the formation of branched isomers, which leads to Cetane ratings less than the corresponding n-paraffins. The disclosure also does not address the issue of cold flow properties simultaneously with high a Cetane number.

Surprisingly, it has now been found by the applicant, that a hydroprocessed middle distillate, such as diesel, may be produced having a high Cetane number as well as good cold flow properties. The middle distillates of the present invention could be used on their own or in blends to improve the quality of other diesel fuels not meeting the current and/or proposed, more stringent fuel quality specifications.

SUMMARY OF THE INVENTION

Thus, according to a first aspect of the invention, there is provided a process for the production of a middle distillate or distillate blend, such as diesel, having a high Cetane number as well as good cold flow properties.

The synthetic middle distillate cut may comprise more than 50% isoparaffins, wherein the isoparaffins are predominantly methyl and/or ethyl and/or propyl branched.

The synthetic middle distillate cut may include more than 50 mass % paraffins lighter than $C_{16}$.

The gradient of an isoparaffins to n-paraffins mass ratio profile of the synthetic middle distillate cut may increase from about 1:1 for $C_8$ to 8.54:1 for $C_{15}$ and decrease again to about 3:1 for $C_{18}$.

Typically, a fraction of the synthetic middle distillate cut in the $C_{10}$ to $C_{18}$ carbon number range has a higher ratio of isoparaffins to n-paraffins than a $C_8$ to $C_9$ fraction of the synthetic middle distillate cut.

The isoparaffins to n-paraffins mass ratio of the $C_{10}$ to $C_{18}$ fraction may be between 1:1 and 9:1.

The isoparaffins to n-paraffins mass ratio may be 8.54:1 for a $C_{15}$ fraction of the synthetic middle distillate cut.

A $C_{19}$ to $C_{24}$ fraction of the middle distillate cut may have a narrow mass ratio range of isoparaffins to n-paraffins of between 3.3:1 and 5:1, generally between 4:1 and 4.9:1.

The mass ratio of isoparaffins to n-paraffins may be adjusted by controlling the blend ratio of hydrocracked to straight run components of the synthetic middle distillate cut. Thus, the isoparaffins to n-paraffins mass ratio of the $C_{10}$ to $C_{18}$ fraction having 30% straight run component may be between 1:1 and 2:5:1.

The isoparaffins to n-paraffins mass ratio of the $C_{10}$ to $C_{18}$ fraction having 20% straight run component may be between 1.5:1 and 3:5:1.

The isoparaffins to n-paraffins mass ratio of the $C_{10}$ to $C_{18}$ fraction having 10% straight run component may be between 2.3:1 and 4.3:1.

The isoparaffins to n-paraffins mass ratio of the $C_{10}$ to $C_{18}$ fraction having substantially only a hydrocracked component may be between 4:1 and 9:1.

At least some of the isoparaffins may be methyl branched. At least some of the isoparaffins may be dimethyl branched. At least 30% (mass) of the isoparaffins are typically monomethyl branched.

Some of the isoparaffins may however be ethyl branched.

TABLE A

Comparison of the Branching Characteristics of Blends of SR, HX and SPD Diesels

| | SR Diesel | | | HX Diesel | | | SPD-Diesel | | |
|---|---|---|---|---|---|---|---|---|---|
| | n-Paraff | I-Paraff | Total | n-Paraff | I-Paraff | Total | n-Paraff | I-Paraff | Total |
| C8 | 1.07 | | 1.07 | 0.38 | | 0.38 | 0.58 | | 0.58 |
| C9 | 22.64 | 1.57 | 24.21 | 1.86 | 5.37 | 7.23 | 6.01 | 3.60 | 9.61 |
| C10 | 14.73 | 1.74 | 16.47 | 1.90 | 8.43 | 10.33 | 6.48 | 6.12 | 12.60 |
| C11 | 5.43 | 0.32 | 5.75 | 1.60 | 8.75 | 10.35 | 6.13 | 6.31 | 12.44 |
| C12 | 11.79 | 0.67 | 12.46 | 1.41 | 8.88 | 10.29 | 6.57 | 5.94 | 12.51 |
| C13 | 11.16 | 0.65 | 11.81 | 1.32 | 8.46 | 9.78 | 6.31 | 6.03 | 12.34 |
| C14 | 11.66 | 0.70 | 12.36 | 1.27 | 8.95 | 10.22 | 6.41 | 5.82 | 12.23 |
| C15 | 9.19 | 0.46 | 9.65 | 1.03 | 8.80 | 9.83 | 4.98 | 4.97 | 9.95 |
| C16 | 4.94 | 0.31 | 5.25 | 0.96 | 6.38 | 7.34 | 2.58 | 3.53 | 6.11 |
| C17 | 0.88 | | 0.88 | 0.88 | 3.92 | 4.80 | 0.76 | 2.33 | 3.09 |
| C18 | 0.08 | | 0.08 | 0.90 | 2.73 | 3.63 | 0.66 | 1.93 | 2.59 |
| C19 | | | | 0.60 | 2.69 | 3.29 | 0.38 | 1.47 | 1.85 |
| C20 | | | | 0.54 | 2.38 | 2.92 | 0.32 | 0.78 | 1.10 |
| C21 | | | | 0.56 | 2.73 | 3.29 | 0.29 | 0.72 | 1.01 |
| C22 | | | | 0.60 | 2.12 | 2.72 | 0.29 | 0.53 | 0.82 |
| C23 | | | | 0.41 | 1.93 | 2.34 | 0.25 | 0.40 | 0.65 |
| C24 | | | | 0.23 | 0.92 | 1.15 | 0.16 | 0.38 | 0.54 |
| C25 | | | | | 0.14 | 0.14 | | | |
| Total | 93.57 | 6.42 | 99.99 | 16.45 | 83.58 | 100.03 | 49.16 | 50.86 | 100.02 |

In the table:
SPD—Sasol Slurry Phase Distillate
SR—Straight Run
HX—Hydrocracked

TABLE B

Branching Characteristics of Blends of SR & HX Diesels

| | iso:normal Paraffins Ratio (mass) | | | |
|---|---|---|---|---|
| SR Diesel (mass) | 0% | 10% | 20% | 30% |
| C8 | 0.0 | 0.0 | 0.0 | 0.0 |
| C9 | 2.9 | 1.3 | 0.8 | 0.5 |
| C10 | 4.4 | 2.4 | 1.6 | 1.1 |
| C11 | 5.5 | 4.0 | 3.0 | 2.3 |
| C12 | 6.3 | 3.3 | 2.1 | 1.4 |
| C13 | 6.4 | 3.3 | 2.1 | 1.4 |
| C14 | 7.0 | 3.5 | 2.2 | 1.5 |
| C15 | 8.5 | 4.3 | 2.7 | 1.8 |
| C16 | 6.6 | 4.3 | 2.9 | 2.1 |
| C17 | 4.5 | 4.0 | 3.6 | 3.1 |
| C18 | 3.0 | 3.0 | 3.0 | 2.9 |
| C19 | 4.5 | 4.5 | 4.5 | 4.5 |
| C20 | 4.4 | 4.4 | 4.4 | 4.4 |
| C21 | 4.9 | 4.9 | 4.9 | 4.9 |
| C22 | 3.5 | 3.5 | 3.5 | 3.5 |
| C23 | 4.7 | 4.7 | 4.7 | 4.7 |
| C24 | 4.0 | 4.0 | 4.0 | 4.0 |
| C25 | | | | |

The branching characteristics of FT diesel is illustrated in FIG. 2.

According to a further aspect of the invention, there is provided a synthetic middle distillate cut having a Cetane number above 70 and a CFPP, in accordance with IP 309, of below −20° C., said distillate having an isoparaffinic content substantially as described above.

In one embodiment, the synthetic middle distillate cut is a FT product.

The invention extends to a diesel fuel composition including from 10% to 100% of a middle distillate cut as described above.

Typically, the diesel fuel composition may include from 0 to 90% of one or more other diesel fuel.

The diesel fuel composition may include at least 20% of the middle distillate cut, the composition having a Cetane number greater than 47 and a CFPP, in accordance with IP 309, below −22° C. The diesel fuel composition may include at least 30% of the middle distillate cut, the composition having a Cetane number greater than 50 and a CFPP, in accordance with IP 309, below −22° C.

The diesel fuel composition may include at least 50% of the middle distillate cut, the composition having a Cetane number greater than 52 and a CFPP, in accordance with IP 309, below −25° C.

The diesel fuel composition may include at least 70% of the middle distillate cut, the composition having a Cetane number greater than 60 and a cold flow plug point, in accordance with IP 309, below −30° C.

The diesel fuel composition may further include from 0 to 10% additives.

The additives may include a lubricity improver.

The lubricity improver may comprise from 0 to 0.5% of the composition, typically from 0.00001% to 0.05% of the composition. In some embodiments, the lubricity improver comprises from 0.008% to 0.02% of the composition.

The diesel fuel composition may include, as the other diesel, a crude oil derived diesel, such as US 2-D grade (low sulphur No. 2-D grade for diesel fuel oil as specified in ASTM D 975-94) and/or CARB (California Air Resources Board 1993 specification) diesel fuel.

According to yet another aspect of the invention, there is provided a process for producing a synthetic middle distillate having a Cetane number higher than 70, the process including:

(a) separating the products obtained from synthesis gas via the FT synthesis reaction into one or more heavier fraction and one or more lighter fraction;

(b) catalytically processing the heavier fraction under conditions which yield mainly middle distillates;

(c) separating the middle distillate product of step (b) from a light product fraction and a heavier product fraction which are also produced in step (b); and (d) blending the middle distillate fraction obtained in step (c) with at least a portion of the one or more lighter fraction of step (a), or products thereof.

The catalytic processing of step (b) may be a hydroprocessing step, for example, hydrocracking.

The process for producing a synthetic middle distillate may include one or more additional step of fractionating at least some of the one or more lighter fraction of step (a), or products thereof, prior to step (d).

The process for producing a synthetic middle distillate may include the additional step of hydrotreating at least some of the one or more light fraction of step (a), or products thereof, prior to step (d).

The one or more heavier fraction of step (a) may have a boiling point above about 270° C., however, it may be above 300° C.

The one or more lighter fraction may have a boiling point in the range $C_5$ to the boiling point of the heavier fraction, typically in the range 160° C. to 270° C.

The product of step (d) may boil in the range 100° C. to 400° C. The product of step (d) may boil in the range 160° C. to 370° C.

The product of step (d) may be a diesel fuel.

The product of step (d) may have a CFPP below −20° C., typically below −30° C., and even below −35° C.

The product of step (d) may be obtained by mixing the middle distillate fraction obtained in step (c) with at least a portion of the one or more lighter fraction of step (a), or products thereof, in a volume ratio of between 1:1 and 9:1, typically 2:1 and 6:1, and in one embodiment, in a volume ratio of 84:16.

The invention extends further to a process for the production of middle distillate fuels from FT primary products, comprising predominantly long chain linear paraffins.

In this process, the waxy product from the FT process is separated into at least two fractions, a heavier and at least one lighter fraction. The lighter fraction may be subjected to mild catalytic hydrogenation to remove hetero-atomic compounds such as oxygen and to saturate olefins, thereby producing material useful as naphtha, solvents, diesel and/or blending components therefor. The heavier fraction may be catalytically hydroprocessed without prior hydrotreating to produce products with good cold flow characteristics. This hydroprocessed heavier fraction could be blended with all or part of the hydrogenated and/or unhydrogenated light fraction to obtain, after fractionation, naphtha and a diesel fuel characterised by a high Cetane number.

The catalysts suitable for the hydroprocessing steps are commercially available and can be selected towards an improved quality of the desired final product.

BRIEF DESCRIPTION OF THE DRAWINGS

The illustrative embodiments may best be described by reference to the accompanying drawings where.

DETAILED DESCRIPTION

Figure 1:
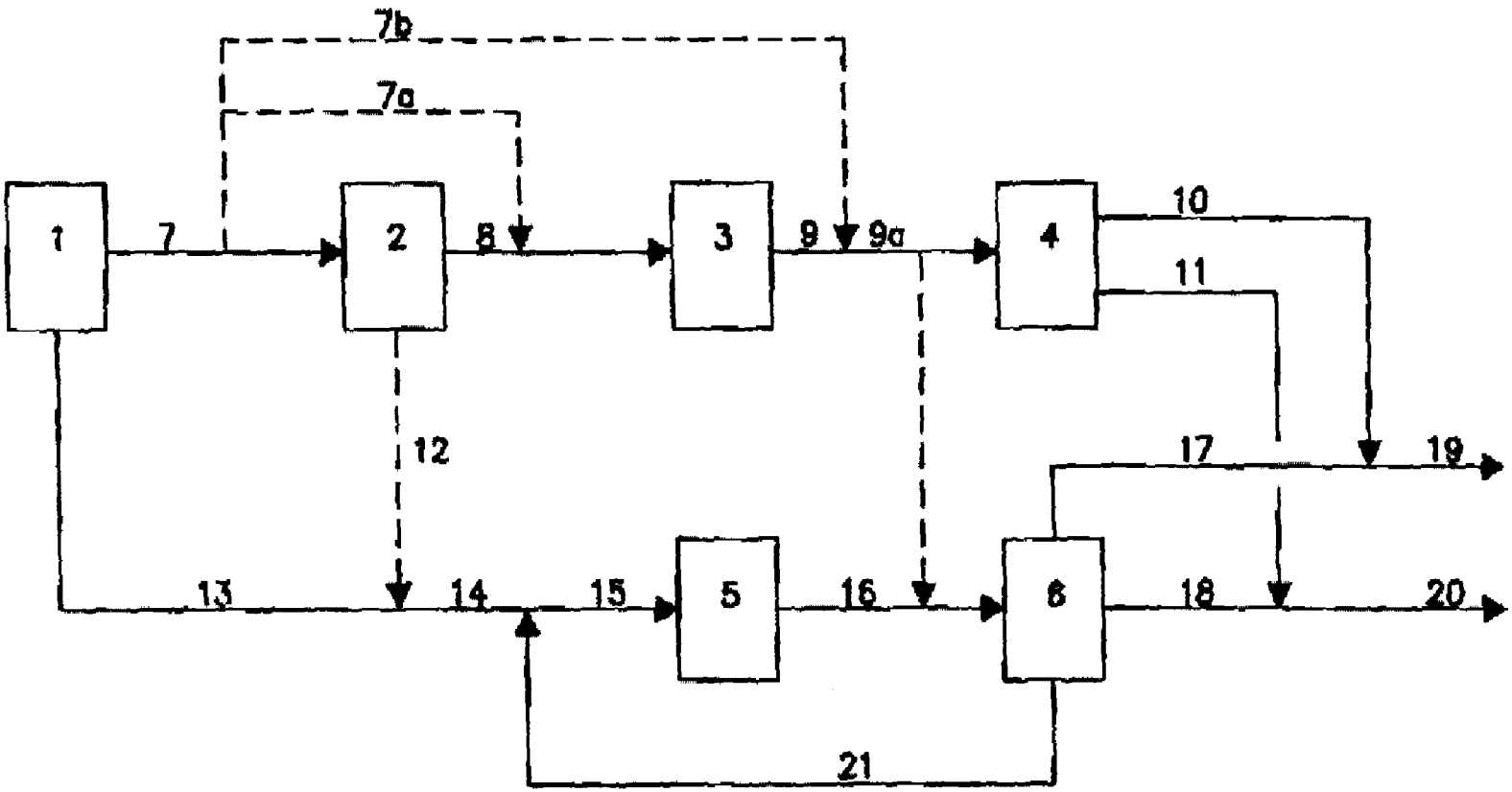
FIG. 1 is a block diagram illustrating a FT work-up process.
Figure 2:
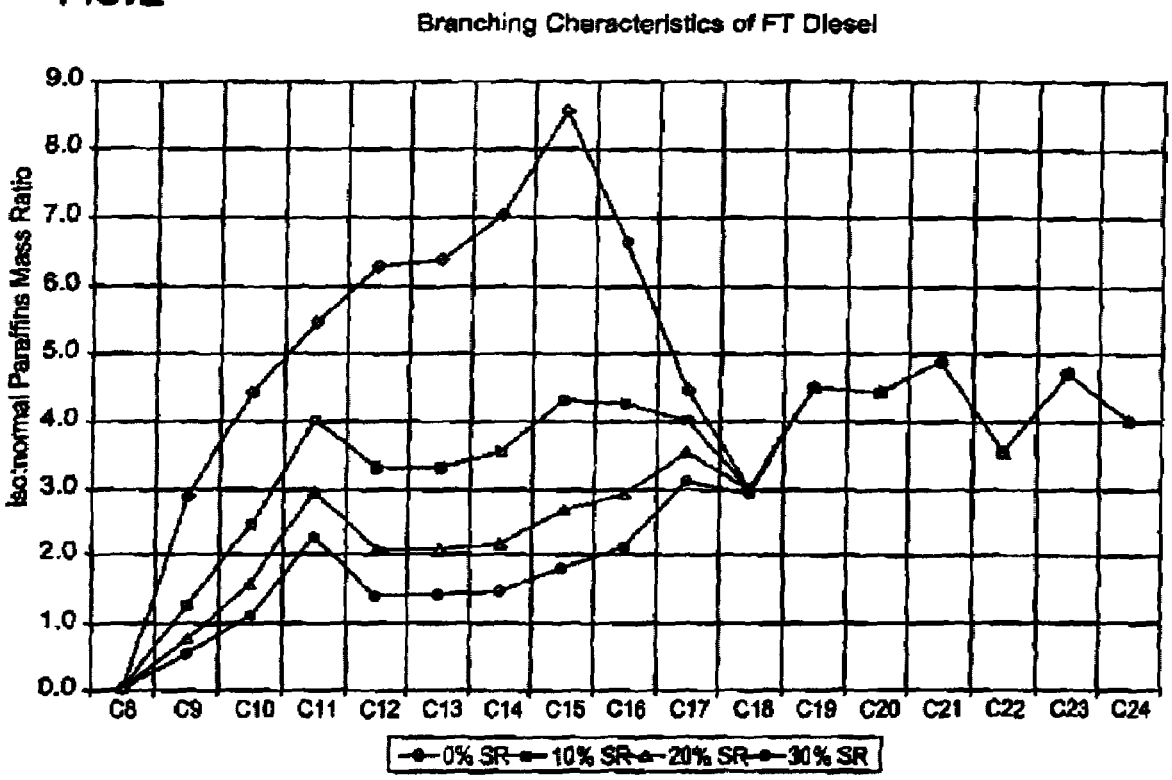
FIG. 2 graphically illustrates the branching characteristics of FT diesel.

This invention describes the conversion of primary FT products into naphtha and middle distillates, for example, diesel having a high Cetane number in excess of 70, while also having good cold flow properties, as described above.

The FT process is used industrially to convert synthesis gas, derived from coal, natural gas, biomass or heavy oil streams, into hydrocarbons ranging from methane to species with molecular masses above 1400.

While the main products are linear paraffinic materials, other species such as branched paraffins, olefins and oxygenated components form part of the product slate. The exact product slate depends on reactor configuration, operating conditions and the catalyst that is employed, as is evident from e.g. Catal. Rev.-Sci. Eng., 23 (1& 2), 265–278 (1981).

Preferred reactors for the production of heavier hydrocarbons are slurry bed or tubular fixed bed reactors, while operating conditions are preferably in the range of 160° C.–280° C., in some cases 210–260° C., and 18–50 Bar, in some cases 20–30 bar.

Preferred active metals in the catalyst comprise iron, ruthenium or cobalt. While each catalyst will give its own unique product slate, in all cases the product slate contains some waxy, highly paraffinic material which needs to be further upgraded into usable products. The FT products can be converted into a range of final products, such as middle distillates, gasoline, solvents, lube oil bases, etc. Such conversion, which usually consists of a range of processes such as hydrocracking, hydrotreatment and distillation, can be termed a FT work-up process.

The FT work-up process of this invention uses a feed stream consisting of $C_5$ and higher hydrocarbons derived from a FT process. This feed is separated into at least two individual fractions, a heavier and at least one lighter fraction. The cut point between the two fractions is preferably less than 300° C. and typically around 270° C.

The table below gives a typical composition of the two fractions, with a ±10% accuracy:

TABLE 1

Typical Fischer-Tropsch product after separation into two fractions (vol % distilled)

| | Condensate (<270° C. fraction) | Wax (>270° C. fraction) |
|---|---|---|
| $C_5$-160° C. | 45 | |
| 160–270° C. | 51 | 3 |
| 270–370° C. | 4 | 35 |
| 370–500° C. | | 42 |
| >500° C. | | 20 |

The >270° C. fraction, also referred to as wax, contains a considerable amount of hydrocarbon material, which boils higher than the normal diesel range. If we consider a typical diesel boiling range of 160–370° C., it means that all material heavier than 370° C. needs to be converted into lighter materials by means of a catalytic process often referred to as hydroprocessing, for example, hydrocracking. Catalysts for this step are of the bifunctional type, i.e. they contain sites active for cracking and for hydrogenation. Catalytic metals active for hydrogenation include group VIII noble metals, such as platinum or palladium, or a sulphided Group VIII base metals, e.g. nickel, cobalt, which may or may not include a sulphided Group VI metal, e.g. molybdenum. The support for the metals can be any refractory oxide, such as silica, alumina, titania, zirconia, vanadia and other Group III, IV, VA and VI oxides, alone or in combination with other refractory oxides. Alternatively, the support can partly or totally consist of zeolite. However, for this invention the preferred support is amorphous silica-alumina.

Process conditions for hydrocracking can be varied over a wide range and are usually laboriously chosen after extensive experimentation to optimize the yield of middle distillates. In this regard, it is important to note that, as in many chemical reactions, there is a trade-off between conversion and selectivity. A very high conversion will result in a high yield of gases and low yield of distillate fuels. It is therefore important to painstakingly tune the process conditions in order to limit the conversion of >370° C. hydrocarbons. Table 2 gives a list of the preferred conditions.

TABLE 2

Process conditions for hydrocracking

| CONDITION | BROAD RANGE | PREFERRED RANGE |
|---|---|---|
| Temperature, ° C. | 150–450 | 340–400 |
| Pressure, barg | 10–200 | 30–80 |
| Hydrogen Flow Rate, $m^3_n/m^3$ feed | 100–2000 | 800–1600 |
| Conversion of >370° C. material, mass % | 30–80 | 50–70 |

Nevertheless, it is possible to convert all the >370° C. material in the feedstock by recycling the part that is not converted during the hydrocracking process.

As is evident from table 1, most of the fraction boiling below 270° C. is already in the typical boiling range for diesel, i.e. 160–370° C. This fraction may or may not be subjected to hydrotreating. By hydrotreating, hetero-atoms are removed and unsaturated compounds are hydrogenated. Hydrotreating is a well-known industrial process, catalyzed by any catalyst having a hydrogenation function, e.g. Group VIII noble metal or sulphided base metal or Group VI metals, or combinations thereof. Preferred supports are alumina and silica.

Table 3 gives typical operating conditions for the hydrotreating process.

TABLE 3

Operating conditions for the hydrotreating process.

| CONDITION | BROAD RANGE | PREFERRED RANGE |
|---|---|---|
| Temperature, ° C. | 150–450 | 200–400 |
| Pressure, bar(g) | 10–200 | 30–80 |
| Hydrogen Flow Rate, $m^3_n/m^3$ feed | 100–2000 | 400–1600 |

While the hydrotreated fraction may be fractionated into paraffinic materials useful as solvents, the applicant has now surprisingly found that the hydrotreated fraction may be directly blended with the products obtained from hydrocracking the wax. Although it is possible to hydroisomerise the material contained in the condensate stream, the applicant has found that this leads to a small, but significant loss of material in the diesel boiling range to lighter material. Furthermore, isomerisation leads to the formation of branched isomers, which leads to Cetane ratings less than that of the corresponding normal paraffins.

The combination of highly linear paraffins derived from the <270° C. fraction and mainly branched paraffins derived from the >270° C. fraction results in a superb diesel.

Important parameters for a FT work-up process are maximization of product yield, product quality and cost. While the proposed process scheme is simple and therefore cost-effective, it produces High Performance Diesel, having a Cetane number >70, and naphtha in good yield. In fact, the process of this invention is able to produce a diesel of hitherto unmatched quality, which is characterized by a unique combination of both high Cetane number and excellent cold flow properties. This is believed to be related to a low degree of isomerisation in the 160–270° C. fraction of the diesel and contrary to this, a high degree of isomerisation in the 270–370° C. fraction of the diesel.

The total amount of isomers in the light boiling range of the diesel (160–270° C. fraction) and the heavier range of the diesel (270° C.–370° C.) are shown in the following table 4.

TABLE 4

Isoparaffins: n-Paraffins of Middle Distillate Fractions

| Boiling Range | Corresponding Carbon Range | Average Iso:Normal Paraffins Ratio Range | Average Iso:Normal Paraffins Ratio Typical value |
|---|---|---|---|
| 160–270° C. | $C_{10}$–$C_{17}$ | 0.5–4.0 | 2.2 |
| 270–370° C. | $C_{17}$–$C_{23}$ | 4.0–14.0 | 10.5 |

The combination of highly linear paraffins derived from the <270° C. fraction and mainly branched paraffins derived from the >270° C. fraction results in a superb diesel.

Important parameters for a FT work-up process are maximization of product yield, product quality and cost. While the proposed process scheme is simple and therefore cost-effective, it produces High Performance Diesel, having a Cetane number >70, and naphtha in good yield. In fact, the process of this invention is able to produce a diesel of hitherto unmatched quality, which is characterized by a unique combination of both high Cetane number and excellent cold flow properties. This is believed to be related to a low degree of isomerisation in the 160–270° C. fraction of the diesel and contrary to this, a high degree of isomerisation in the 270–370° C. fraction of the diesel.

The relatively high percentage of normal paraffins in the light boiling range contributes to the high Cetane number of the diesel fuel, without affecting the cold flow properties. On the other hand, in the heavier range of the diesel, branching is of utmost importance because the linear hydrocarbons in this range provide very poor cold flow properties and in some cases, may even crystallize. Therefore, the amount of iso-paraffins in this range is maximised during hydroprocessing under the process conditions described herein.

It is this unique composition of the synthetic fuel, which is directly caused by the way in which the FT work-up process of this invention is operated, that leads to the unique characteristics of said fuel.

The applicant has also found, that from the perspective of fuel quality, it is not necessary to hydrotreat the <270° C. fraction, adding said fraction directly to the products from hydrocracking the wax. While this results in the inclusion of oxygenates and unsaturates in the final diesel, fuel specifications usually allow for this. Circumventing the need for hydrotreatment of the condensate results in considerable savings of capital and operating costs.

The described FT work-up process of FIG. 1 may be combined in a number of configurations. The applicant considers these an exercise in what is known in the art as Process Synthesis Optimisation.

However, the specific process conditions for the Work-up of FT primary products, the possible process configurations of which are outlined in Table 5, were obtained after extensive and laborious experimentation and design.

TABLE 5

Possible Fischer-Tropsch Product Work-up Process Configurations

| Process Step | | Process Configuration | | | | | |
|---|---|---|---|---|---|---|---|
| | | A | B | C | D | E | F |
| 2 | Light FT Product Fractionator | | | X | | | X |
| 3 | Light FT Product Hydrotreater | X | X | | | X | X |
| 4 | Hydrotreater Products Fractionator | | X | | | X | X |
| 5 | Waxy FT Product Hydrocracker | X | X | X | X | X | X |
| 6 | Hydrocracked Products Fractionator | X | X | X | X | X | X |

Numbers reference numerals of FIG. 1
FT Fischer-Tropsch

The basic process is outlined in the attached FIG. 1. The synthesis gas (syngas), a mixture of Hydrogen and Carbon monoxide, enters the FT reactor 1 where the synthesis gas is converted to hydrocarbons by the FT reaction.

A lighter FT fraction is recovered in line 7, and may or may not pass through fractionator 2 and hydrotreater 3. The product 9 from the hydrotreater may be separated in fractionator 4 or, alternatively, mixed with hydrocracker products 16 sent to a common fractionator 6.

A waxy FT fraction is recovered in line 13 and sent to hydrocracker 5. If fractionation 2 is considered the bottoms cut 12 are be sent to hydrocracker 5. The products 16, on their own or mixed with the lighter fraction 9*a*, are separated in fractionator 6.

Depending on the process scheme, a light product fraction, naphtha 19, is obtained from fractionator 6 or by blending equivalent fractions 10 and 17. This is a $C_5$-160° C. fraction useful as naphtha.

A somewhat heavier cut, synthetic diesel 20, is obtainable in a similar way from fractionator 6 or by blending equivalent fractions 11 and 18. This cut is recovered as a 160–370° C. fraction useful as diesel.

The heavy unconverted material 21 from fractionator 6 is recycled to extinction to hydrocracker 5. Alternatively, the residue may be used for production of synthetic lube oil bases. A small amount of $C_1$–$C_4$ gases are also separated in fractionator 6.

The following examples will serve to illustrate further this invention.

EXAMPLES

Example 1

A commercially available hydrocracking catalyst was used for hydrocracking of a non-hydrotreated FT hydrocarbon fraction with an initial boiling point of about 280° C. The active metals on the catalyst comprised cobalt and molybdenum, while the support was amorphous silica-alumina. Operating conditions were temperatures between 375 and 385° C., pressure of 70 bar and hydrogen flow rate of 1500 $m^3_n/m^3$ feed. The experiment was carried out in a pilot plant reactor. The conversion of >370° C. material to lighter material ranged between 65 and 80%. Diesel component A is obtained after fractionation of the reactor products. The properties of this diesel component are given in table 1.

Example 2

A non-hydrotreated FT hydrocarbon fraction with a final boiling point of ca 285° C. and alcohol content of ca. 4.3 mass %, expressed as n-hexanol, was rigorously hydrotreated using a commercially available catalyst. The active metals on the catalyst comprised molybdenum and cobalt, while the support was alumina. The process conditions were temperatures around 250° C. pressure of 68 bar and hydrogen flow rate of 1070 $m^3_n/m^3$ feed. The test was carried in a commercial scale fixed bed reactor. Diesel components B and C were obtained after fractionation of respectively the reactor feed and reactor product. The properties of these diesel components are given in table 6.

TABLE 6

Diesel Blending Components

| | Component A | Component B | Component C |
|---|---|---|---|
| ASTM D86 distillation | | | |
| IBP, ° C. | 185 | 161 | 186 |
| 10%, ° C. | 211 | 188 | 198 |
| 50%, ° C. | 269 | 224 | 223 |
| 90%, ° C. | 338 | 263 | 259 |
| FBP, ° C. | 361 | 285 | 279 |
| Density, kg/dm³ @ 20° C. | 0.7766 | 0.7641 | 0.7515 |
| Viscosity, cSt @ 40° C. | 2.66 | 1.81 | 1.54 |
| Flash Point, ° C. | 76 | 61 | 72 |
| Cold Filter Plugging Point, ° C. | −32 | −18 | −17 |
| Cetane Number | 69 | 71 | >74 |

Example 3

The diesel fraction obtained from hydrocracking a heavy FT material (component A) was blended with a hydrogenated lighter FT material (component B) in a volume ratio of 84:16. The properties of the final blend, called Blend I, are given in table 7.

Those skilled in the art will realize that Blend I may be used on its own, but also as a blending feedstock. The combination of a high Cetane numbers, above 70, and excellent cold flow properties, with CFPP substantially better than −20° C., make Blend I an ideal blending feedstock to upgrade crude oil derived diesels.

Example 4

The diesel fraction obtained from hydrocracking a heavy FT material (component A) was directly blended with a lighter non-hydrogenated FT material (component C) in a volume ratio of 84:16. The properties of the final blend, called Blend II, are given in table 7.

Similar to example 3, Blend II may be used on its own, but also as a blending feedstock. In addition to a high Cetane numbers, above 70, and excellent cold flow properties, with CFPP substantially better than −20° C., Blend II contains alcohols and smaller quantities of other oxygenates, the level of which depend on the blending ratio used to prepare the blend.

TABLE 7

| Diesel Blends | Blend I | Blend II |
|---|---|---|
| ASTM D86 distillation | | |
| IBP, ° C. | 189 | 185 |
| 10%, ° C. | 209 | 208 |
| 50%, ° C. | 256 | 257 |
| 90%, ° C. | 331 | 332 |
| FBP, ° C. | 356 | 358 |
| Density, kg/dm$^3$ @ 15° C. | 0.7769 | 0.7779 |
| Viscosity, cSt @ 40° C. | 2.43 | 2.42 |
| Flash Point, ° C. | 73 | 67 |
| Cold Filter Plugging Point, ° C. | −37 | −34 |
| Cetane Number | >73.7 | 73.3 |

Example 5

Figure 3:
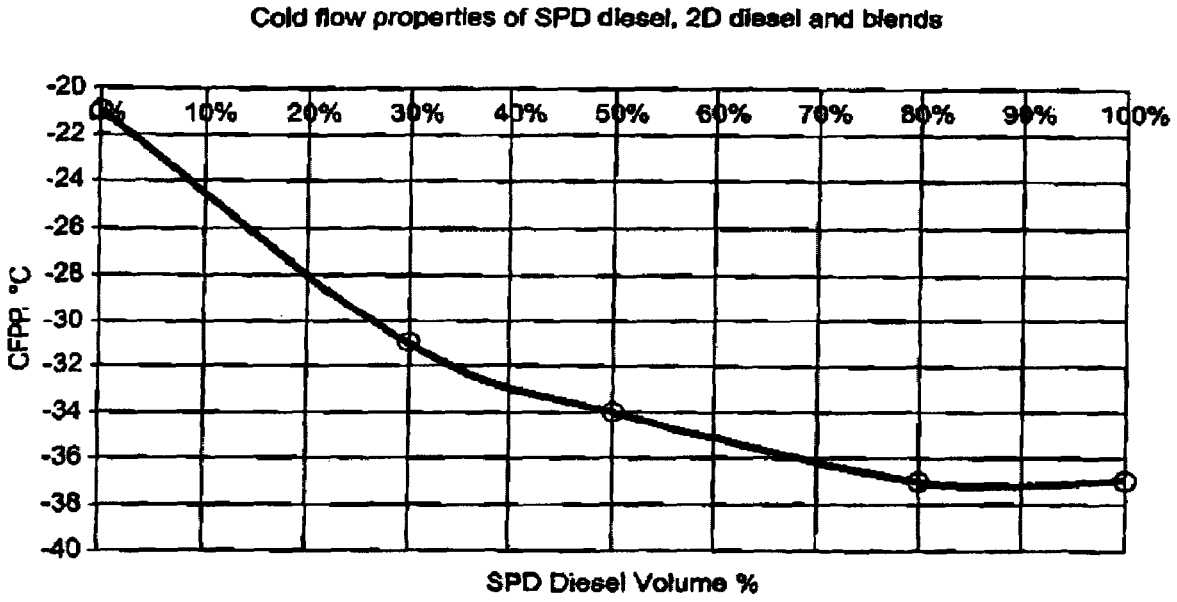
FIG. 3 graphically illustrates the cold flow properties of SPD diesel, 2D diesel and blends of Table 8.
Figure 4:
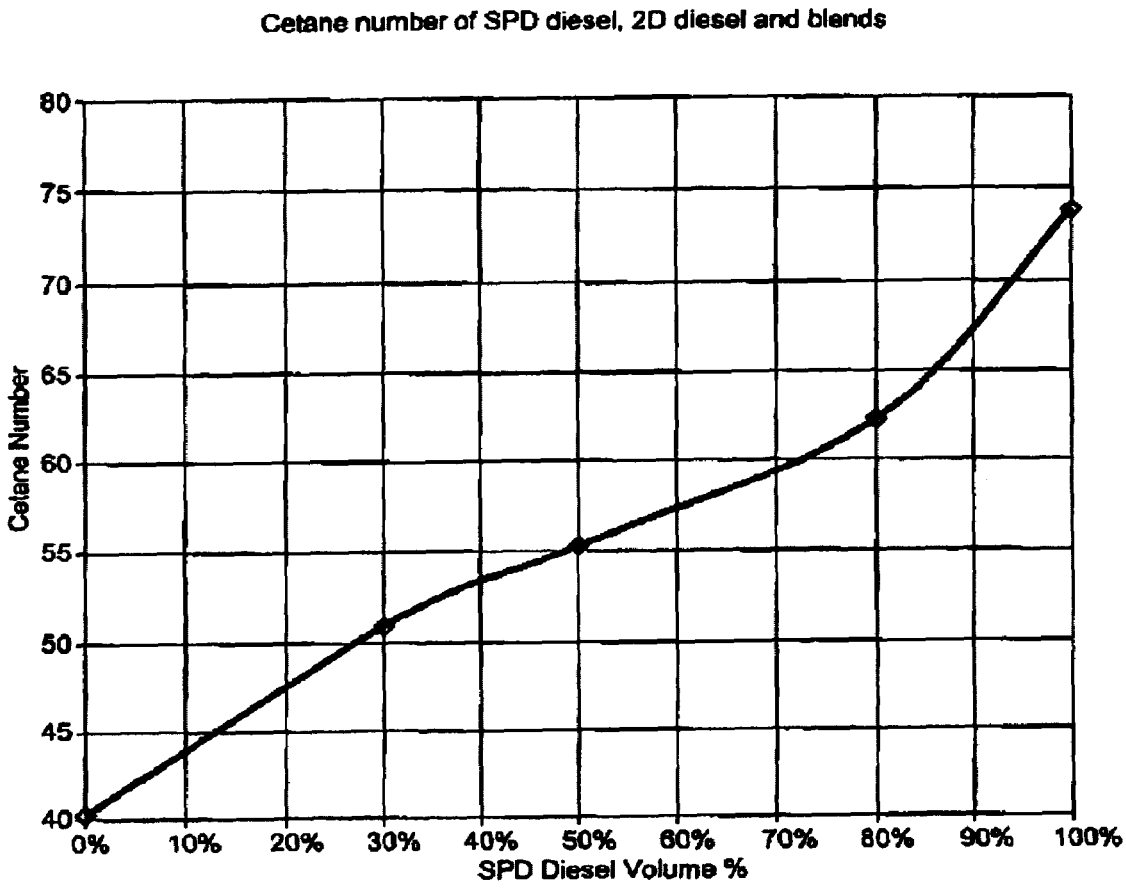
FIG. 4 graphically illustrates the Cetane number of SPD diesel, 2D diesel and blends of Table 8.

The diesel Blend I of Example 3 was blended with US 2-D grade diesel, whereby desired Cetane number and CFPP properties, as shown in Table 8 and FIGS. 3–4, were obtained.

TABLE 8

Performance properties of Sasol SPD diesel, 2D diesel and blends

| PROPERTY | TEST METHOD | SASOL SPD DIESEL | 80:20 SPD:2D | 50:50 SPD:2D | 30:70 SPD:2D | US 2-D GRADE DIESEL |
|---|---|---|---|---|---|---|
| Cetane number | ASTM D 270 | >73.7 | 62.2 | 55.2 | 50.9 | 47 (min) |
| CFPP (° C.) | IP 309 | −37 | −37 | −34 | −31 | −21 |
| Thermal Stability (% reflectance) | Octel F21-61 test (180 minutes, 150° C.) | 99.1 | 90 | 81.2 | 70.4 | 66.5 |
| Lubricity: SL BOCLE (g) HFRR (WSD in um) | ASTM D 6078/ CEC F-06-A-96 | 2700/567 | 2700/491 | 3050/473 | 3650/491 | 3950/485 |

The invention claimed is:

1. A synthetic middle distillate cut comprising more than 50 mass % paraffins lighter than $C_{16}$ and in which more than 50 mass % of the total paraffins of the middle distillate cut are isoparaffins, and wherein the isoparaffins being predominantly methyl and/or ethyl and/or propyl branched wherein a $C_{10}$ to $C_{18}$ fraction of the synthetic middle distillate cut has a mass ratio range of isoparaffins to n-paraffins of between 1:1 and 9:1;

a $C_8$ to $C_9$ fraction of the synthetic middle distillate cut has a mass ratio range of isoparaffins to n-paraffins lower than that of the $C_{10}$ to $C_{18}$ fraction; and a $C_{19}$ to $C_{24}$ fraction of the synthetic middle distillate cut has a mass ratio range of isoparaffins to n-paraffins of from 3.3:1 and 5:1.

2. A synthetic middle distillate cut as claimed in claim 1, wherein the isoparaffins to n-paraffins mass ratio profile of the synthetic middle distillate cut increases from about 1:1 for $C_8$ to 8.54:1 for $C_{15}$ and decrease again to about 3:1 for $C_{18}$.

3. A synthetic middle distillate cut as claimed in claim 2, wherein the $C_{19}$ to $C_{24}$ fraction of the middle distillate cut has a mass ratio range of isoparaffins to n-paraffins of between 4:1 and 4.9:1.

4. A synthetic middle distillate cut as claimed in claim 2 which comprises 30 mass % of a straight run component thereby selecting the isoparaffins to n-paraffins mass ratio of the $C_{10}$ to $C_{18}$ fraction to between 1:1 and 2.5:1.

5. A synthetic middle distillate cut as claimed in claim 2, which comprises 20 mass % of a straight run component thereby selecting the isoparaffins to n-paraffins mass ratio of the $C_{10}$ to $C_{18}$ fraction to between 1.5:1 and 3.5:1.

6. A synthetic middle distillate cut as claimed in claim 2, which comprises 10 mass % of a straight run component thereby selecting the isoparaffins to n-paraffins mass ratio of the $C_{10}$ to $C_{18}$ fraction to between 2.3:1 and 4.3:1.

7. A synthetic middle distillate cut as claimed in claim 1, wherein the isoparaffins to n-paraffins mass ratio of the $C_{10}$ to $C_{18}$ fraction having substantially only a hydrocracked component is between 4:1 and 9:1.

8. A middle distillate cut as claimed in claim 1, wherein at least some of the isoparaffins are di-methyl branched.

9. A middle distillate cut as claimed in claim 1, wherein at least 30 mass % of the isoparaffins are mono-methyl branched.

10. A middle distillate cut as claimed in claim 1, wherein at least some of the isoparaffins are ethyl branched.

11. A middle distillate cut as claimed in claim 1, wherein the ratio of isoparaffins to n-paraffins of the middle distillate cut is from about 1:1 to about 9:1.

12. A synthetic middle distillate cut as claimed in claim 11, wherein the isoparaffins to n-paraffins mass ratio is between about 2:1 to about 6:1.

13. A synthetic middle distillate cut as claimed in claim 12, wherein the isoparaffins to n-paraffins mass ratio is 4:1.

14. A synthetic middle distillate cut as claimed in claim 1, having a light fraction in the boiling range 160° C. to 270° C. wherein the isoparaffins to n-paraffins mass ratio of the light fraction is from 1:2 to 4:1.

15. A synthetic middle distillate cut as claimed in claim 14, having the light fraction in the boiling range 160° C. to 270° C. wherein the isoparaffins to n-paraffins mass ratio of the light fraction is 2.2:1.

16. A synthetic middle distillate cut as claimed in claim 1, having a heavy fraction in the boiling range 270° C. to 370° C. wherein the isoparaffins to n-paraffins mass ratio of the heavy fraction is from 4:1 to 5:1.

17. A synthetic middle distillate cut as claimed in claim 1, wherein the synthetic distillate is derived from one or more FT primary product.

* * * * *